US007243757B2

(12) United States Patent
Stuber

(10) Patent No.: US 7,243,757 B2
(45) Date of Patent: Jul. 17, 2007

(54) EXHAUST MUFFLER

(75) Inventor: Karl Bernard Stuber, Los Angeles, CA (US)

(73) Assignee: Edelbrock Corporation, Torrance, CA (US)

( * ) Notice: Subject to any disclaimer, the term of this patent is extended or adjusted under 35 U.S.C. 154(b) by 245 days.

(21) Appl. No.: 10/975,729

(22) Filed: Oct. 28, 2004

(65) Prior Publication Data

US 2006/0090957 A1 May 4, 2006

(51) Int. Cl.
*F01N 1/06* (2006.01)
*F01N 1/02* (2006.01)
*F01N 1/00* (2006.01)

(52) U.S. Cl. ..... 181/270; 181/251; 181/257; 181/268; 181/275; 181/249; 181/255; 181/269; 181/264; 181/272

(58) Field of Classification Search ..... 181/251, 181/257, 268, 275, 249, 255, 269, 270, 264, 181/272
See application file for complete search history.

(56) References Cited

U.S. PATENT DOCUMENTS

| | | | | | |
|---|---|---|---|---|---|
| 981,584 | A * | 1/1911 | Miller | ..... | 181/253 |
| 1,002,801 | A * | 9/1911 | Boeck | ..... | 181/264 |
| 1,677,570 | A * | 7/1928 | Stade | ..... | 181/269 |
| 2,906,364 | A * | 9/1959 | Crouch et al. | ..... | 181/255 |
| 2,948,210 | A * | 8/1960 | Conlan | ..... | 454/262 |
| 3,685,261 | A * | 8/1972 | McIlvaine et al. | ..... | 96/262 |
| 4,064,962 | A * | 12/1977 | Hunt | ..... | 181/272 |
| 4,111,279 | A | 9/1978 | Sterrett | | |
| 4,185,715 | A | 1/1980 | Boiu | | |
| 4,501,341 | A | 2/1985 | Jones | | |
| 4,574,914 | A | 3/1986 | Flugger | | |
| 5,304,749 | A * | 4/1994 | Crandell | ..... | 181/264 |
| 5,444,197 | A | 8/1995 | Flugger | | |
| 5,739,484 | A | 4/1998 | Jones | | |
| 5,773,770 | A | 6/1998 | Jones | | |
| 5,824,972 | A * | 10/1998 | Butler | ..... | 181/279 |
| 6,089,347 | A | 7/2000 | Flugger | | |
| 6,364,054 | B1 * | 4/2002 | Bubulka et al. | ..... | 181/264 |
| 6,622,821 | B2 * | 9/2003 | Butler | ..... | 181/270 |
| 6,651,773 | B1 | 11/2003 | Marocco | | |

* cited by examiner

*Primary Examiner*—Lincoln Donovan
*Assistant Examiner*—Jeremy Luks
(74) *Attorney, Agent, or Firm*—Ronald M. Goldman

(57) ABSTRACT

An exhaust muffler (1) invention includes an entry chamber (9), a resonator chamber (15), and a baffle chamber (23) positioned in serial order between an exhaust gas inlet (3) that lets exhaust gas into the entry chamber and an exhaust gas outlet (5) from the baffle chamber that lets the exhaust gas exit to the exterior. A pass-through tube (21) provides an exhaust gas passage extending from the first entry chamber, through the resonator chamber and into the baffle chamber; and a baffle system (2,4,6, 8, 10, 12 & 14) located in the baffle chamber, contains a plurality of baffles positioned between the resonator chamber at one end and said exhaust gas outlet at the other end for reflecting sound admitted into said baffle chamber via said pass-through tube, whereby interference patterns of reflected sound are produced that lessen the intensity of the sound that exits along with exhaust gas from said outlet tube. In accordance with an additional aspect to the invention, the resonator chamber is contiguous with the entry chamber on one side and with said baffle chamber on an opposed side.

14 Claims, 3 Drawing Sheets

EXHAUST MUFFLER

FIELD OF THE INVENTION

My invention relates to attenuating sound, and, more particularly, to sound dampening exhaust mufflers for internal combustion engines.

BACKGROUND

Internal combustion engines used in automobiles, light trucks and sport utility vehicles, and, particularly those engines fueled by gasoline, inherently produce a loud and irritating roar through the engine exhaust during operation that requires muffling to be bearable to one's ears and, of course, to be legal. Even so, the external noise becomes particularly loud and irritating when the gas pedal is quickly depressed to force the engine to rapidly accelerate to a high rpm. Modern vehicles include the catalytic converter for environmental protection reasons. That device fits in the exhaust system between the engine and muffler and mitigates the exhaust noise slightly, but not significantly. Most factory installed mufflers do the legally required job of dampening the sound to legal levels. What enthusiasts prefer is to convert the sound to a soft melodious sound called the performance sound without robbing the engine of some performance.

During the exhaust portion of the four-stroke engine cycle that follows combustion of the fuel and air mixture that's confined in the engine cylinder, the cylinder exhaust valve associated with an engine cylinder opens and the piston, being moved upwardly in the cylinder toward the exhaust valve, forces the products of combustion from the cylinder. Typical internal combustion engines contain multiple engine cylinders, four, six or eight cylinders, as example. Each cylinder in the engine is "fired" in serial order during the associated compression stage for the cylinder. Once fired, the resulting gaseous products of combustion are exhausted from the cylinder during the succeeding exhaust stage. The repetitive expulsion of the hot exhaust gases forced from each engine cylinder, in turn, and the rapid expansion of those gases into the exhaust manifold of the engine generates noise that is in part periodic in nature. The hot exhaust gas empties into the exhaust manifold and thence flows into the exhaust runners to the exhaust muffler, or, if the vehicle contains a catalytic converter, the metal tubes leading to the catalytic converter, and from the catalytic converter and thence through the exhaust muffler. In either arrangement, from the exhaust muffler the exhaust gas empties into the tailpipe and, thence, to the exterior atmosphere, where the exhaust gas is expelled and the sound is broadcast. With multiple engine cylinders, the foregoing exhaust action of engine operation produces a periodic series of gas pressure pulses and the repetition rate of those pulses varies as a function of the engine rpm. Typically, that pulse rate lies within the audio frequency range.

A typical exhaust muffler provided on the gasoline fueled automobiles of major automobile manufacturers, the OEM muffler, contains several perforated pipes housed within a closed chamber. One of those pipes, the inlet pipe, empties into a front chamber within the housing or casing, while the second pipe provides an exit from a rear chamber. A resonator chamber located at the front of the housing, but behind the front chamber, is also coupled by a pipe or passage to the rear of the front chamber. The resonator contains a specific volume of air and has a specific length that is calculated to produce a sound wave that cancels out a certain frequency of sound. Sound reduction in the muffler relies upon the sound cancellation produced by having reflected and direct portions of the exhaust gas pulse combine in opposite phase inside the muffler so that the sound released through the tailpipe is reduced in level.

Because the pulses of exhaust gas introduced into the muffler must pass through the inlet pipe and exit against a wall in the first chamber and thence return to the middle chamber, one effect of the presence of that barrier wall is to produce a back-pressure at the inlet. Although the OEM muffler sufficiently dampens the harsh sounds produced at the outlet of the tailpipe, the obstruction created by the chamber wall inside the muffler housing produces a back pressure in the exhaust path from the manifold. To overcome the effect of that back pressure, the engine must perform extra work to pump out the exhaust gas. In effect, the back pressure robs the engine of some amount of horsepower that could otherwise be obtained from the engine if the exhaust gas were exhausted directly to the atmosphere without obstruction.

To reduce that back pressure and increase the available horsepower from the engine, performance mufflers were introduced as an after-market product to replace the OEM muffler. Serious performance aficionados could then replace the original equipment muffler with a performance muffler and achieve both better performance and a more desirable sound from the tailpipe.

The OEM mufflers are principally designed to muffle sound. Performance mufflers, on the other hand, are designed not only to muffle the exhaust sound, but also produce a satisfying sound of low frequency and timbre characteristic of performance vehicles. That sound is sometimes referred to as a performance sound. Psychologically, the performance sound gives an audible clue that the vehicle contains great horsepower. Difficult to describe with words and lacking precise definition, the sound may be said to be one that one knows when one hears the sound. As an advantage, the present invention also delivers performance sound.

Performance mufflers previously marketed by others appear to function by one of two basic techniques. One design incorporates fiberglass matting, a sound absorbent material on the outer walls of a perforated tube. The matting absorbs the sound of the resonant audio frequency produced by the exhaust gas as the exhaust gas moves through the perforations in the tube and dampens the sound to tolerable levels within the legal limit. Unfortunately, the matting often breaks down after prolonged use and is discharged into the tailpipe. The matting also absorbs oil and metallic minerals as may be included in the exhaust gases. The accumulation of those substances reduces the sound absorbency of the matting and, hence, the ability of the muffler to absorb or dampen the exhaust sound level. When that occurs, the muffler must be replaced.

The better performance mufflers rely on a chamber single deflector technology which does not require a packing of sound absorbent material. Instead the muffler permits the exhaust gases to flow through the muffler and exit the tail pipe more easily than the OEM packed muffler and produces a lower back pressure. The exhaust gases are directed in a path inside the muffler housing defined by internal metal baffles. Exhaust gas introduced into the performance muffler is directed through internal chambers to the right and the left of the muffler inlet. The foregoing path for the exhaust gas is less restrictive and permits the engine to develop greater horsepower than the absorbent packed muffler, while producing a deep throated rumbling sound desired by many as an advertisement of the power of their automobile engine, often called performance sound. Performance mufflers of the foregoing type have been available for some time from the Flowmaster Company of Santa Rosa, Calif. and variations of that muffler are described in U.S. Pat. No. 4,574,914, U.S. Pat. No. 4,809,812 and U.S. Pat. No. 5,123,502 to which the reader may make reference.

The adaptation of emission controls on automobile internal combustion engines made combustion more efficient and lowered exhaust gas temperatures and catalytic converters were included in the routing of the exhaust gas, all of which aids the effectiveness and/or reliability of an exhaust gas muffler. Although of aid, those additional systems are not for the purpose of muffling engine noise at the exterior and do not do so.

Although solving the problem of exterior noise as might be experienced by a bystander to the vehicle, the muffler should also minimize the engine noise that reaches the interior of the automobile and could be disturbing to the automobile owner. In practice, one finds that OEM mufflers and performance mufflers don't always provide appropriate muffling under all driving conditions. As example, it is found that the internal combustion engine of many sport utility vehicle produces a sound in the interior of the vehicle that is discomforting, if not irritating, that occurs when the engine is operating at about 2200 rpm, which typically corresponds to driving the automobile at a speed of about sixty miles per hour, a typical cruising speed. The engine also produces that annoying sound on acceleration as the engine passes through the 2200 rpm speed. Though the muffler achieves sufficient quietude at other speeds, it appears to produce or allow a resonance inside the vehicle cabin at the 2200 rpm engine speed, which is obviously undesirable.

Then too, when the engine is operating at a high speed above 2200 rpm and the driver removes his foot from the accelerator pedal to allow the vehicle to decelerate, an annoying crackling or "popping" sound is produced inside the cabin that originates at the muffler. That sound is disconcerting to most drivers who may think an engine backfire is imminent. Small pick-up trucks experience a similar problem with cabin sound that the muffler fails to handle when the truck is placed under a heavy load, such as when towing a camper or recreational vehicle, horse trailer or the like.

Muffler durability is also a problem. One finds that some performance mufflers develop hot spots on the muffler case during engine operation. Sometimes the intensity of a hot spot is so great as to produce through localized thermal expansion a bulge in the side of the metal muffler case. That thermal action is likely to lead to a break through in the side of the muffler through which exhaust gases and sound escapes to the exterior. Should that occur, the muffler must be replaced. The foregoing hot spots appear to inherently result from the effect of the baffles located inside the performance muffler, earlier noted. Apparently, a portion of the exhaust gas passing through the muffler is diverted by the internal baffles to create localized vortexes of hot gases in the interior of the muffler. Those vortexes remain stationary in location and don't readily exit the muffler, producing steady heating at a spot on the side of the muffler that, like a blowtorch, ultimately burns through the metal of the muffler case.

Even before any burn-through occurs, the very high temperatures in the performance muffler that are produced by such hot spots often results in driver discomfort or increased fuel consumption. Located on the undercarriage of the vehicle the heat from the muffler is conducted or convected in some measure through the vehicle flooring to the interior of the automobile, which, in the summer, is discomforting to the driver, if automobile air conditioning is unavailable. If air conditioning is available, prolonged operation of the air conditioner is necessary to dissipate the accumulating heat and maintain a comfortable cabin temperature. But prolonged operation of the air conditioner results in greater gasoline consumption, lowering overall engine efficiency.

A performance muffler recently licensed to and marketed by the Edelbrock Corporation, the assignee of the present invention, greatly reduces the potential for such burn-through and vehicle interior heating, while sufficiently dampening engine sound. That is a now patented muffler invented by Mr. Ron Petracek described in a U.S. patent application, entitled "Exhaust Muffler for Internal Combustion Engines," Ser. No. 10/714,086, and now U.S. Pat. No. 7,044,266, manufactured by Edelbrock Corporation under license. The muffler includes an internal tubular member that contains a louvered cylindrical wall and a number of criss-crossed baffles have an edge positioned facing the incoming stream of exhaust gas, dividing the stream and sound associated with the stream into four parts, leading to the rear of the louvered tube, and another smaller size pair of criss-crossed baffles on either side of the louvered tube with the crossed edges oriented facing an associated small opening in the front circular muffler wall. That muffler has been found to be more effective on diesel engines.

Accordingly, an object of the present invention is to provide an exhaust gas muffler for internal combustion engines.

And, It is a further object of the invention to provide a performance muffler that attenuates the harsh sound of the engine with minimal reduction of engine performance.

SUMMARY OF THE INVENTION

In accordance with the foregoing objects, the exhaust muffler invention includes an entry chamber, a resonator chamber, and a baffle chamber positioned in serial order between an exhaust gas inlet that lets exhaust gas into the entry chamber and an exhaust gas outlet from the baffle chamber that lets the exhaust gas exit to the exterior. A pass-through tube for providing an exhaust gas passage extending from the first entry chamber, through the resonator chamber and into the baffle chamber; and a baffle system, located in the baffle chamber, that contains a plurality of baffles positioned between the resonator chamber at one end and said exhaust gas outlet at the other end for reflecting sound admitted into said baffle chamber via said pass-through tube, whereby interference patterns of reflected sound are produced that lessen the intensity of the sound that exits along with exhaust gas from said outlet tube. In accordance with an additional aspect to the invention, the resonator chamber is contiguous with the entry chamber on one side and with said baffle chamber on an opposed side;

As inspection of the patent literature reveals, the exhaust muffler has been the subject of interest to many inventors over the past years. Further, one finds that exhaust mufflers of various types have been marketed heretofore. In general, those who precede the present inventor may likely have (or have had) the same general goals as the present applicant. The prior art contains exhaust mufflers that contain Helmholtz resonators. The prior art also shows exhaust mufflers that contain baffles. Both were intended to reduce sound and obtain the performance sound with a specific internal combustion engine. Despite such precedent, one does not find an exhaust muffler with the combination of Helmholtz resonator and baffle system described herein or even one with only a baffle system such as prescribed herein.

DETAILED DESCRIPTION OF THE PREFERRED EMBODIMENT

Figure 1:
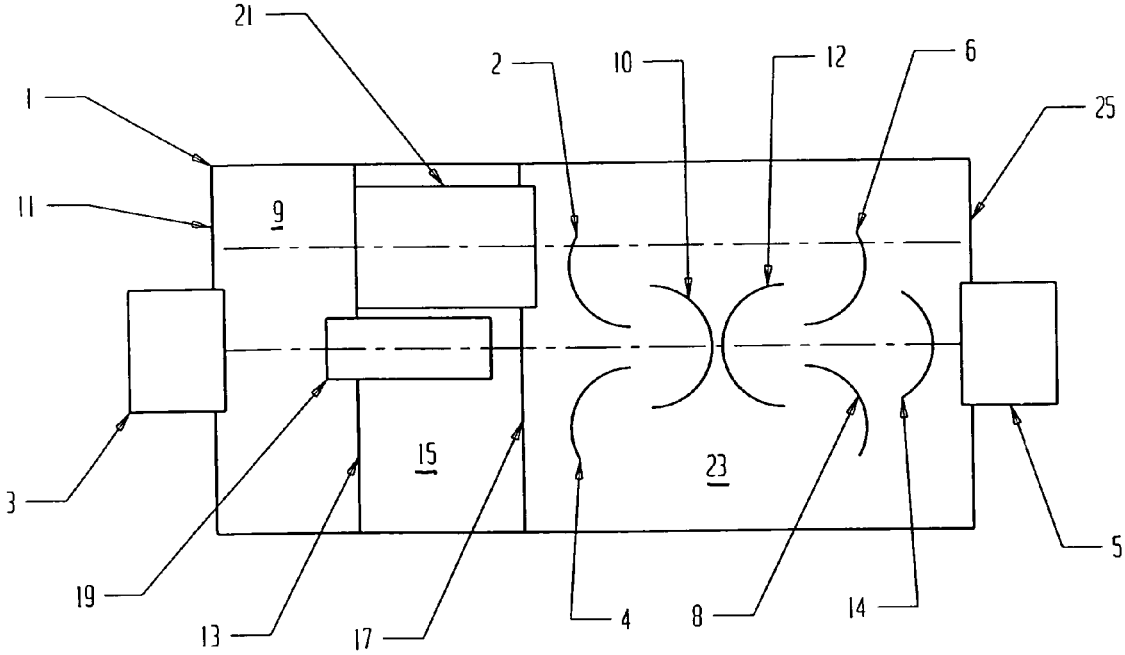
FIG. 1 is a pictorial schematic of the preferred embodiment of the invention.
Figure 6:
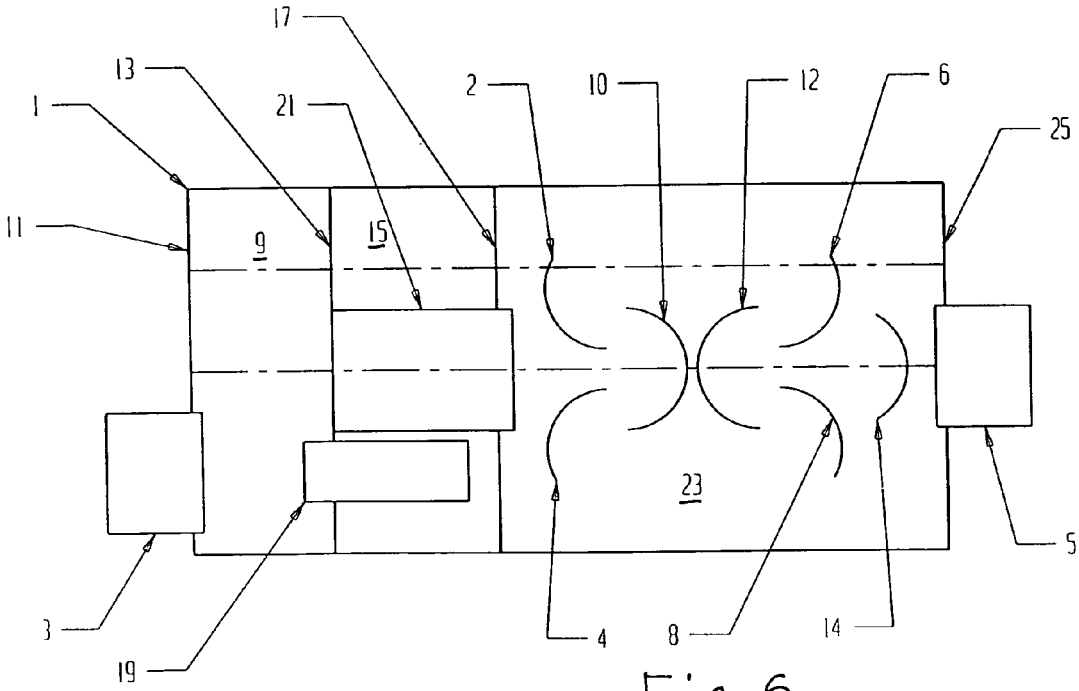
FIG. 6 is a pictorial schematic of a second embodiment of the invention.

FIG. 1 to which reference is made, presents a pictorial schematic of my new muffler 1. The muffler includes a nipple or inlet tube 3, through which engine exhaust gas from the catalytic converter (or engine) is admitted into the interior of muffler 1, and an outlet tube 5 on the opposite end, through which the exhaust gas is expelled. The inlet and outlet tubes are connected to end caps or, as variously termed, end walls 11 and 25, respectively. A muffler casing 7 encloses the internal elements of the muffler that are represented in the schematic, including end walls 11 and 25. Inlet tube 3 opens into a first chamber 9, an entry chamber, located in the interior of the muffler. That chamber is formed between front end cap or end wall 11, an internal wall 13 and a portion of the side wall of casing 7. A second interior chamber 15, the resonator chamber, is formed between front internal or resonator wall 13 and a second rear internal wall 17, the rear resonator wall, laterally axially spaced to the right from wall 13. A third tubular member 19, the resonator tube, is mounted in internal wall 13 coaxial with the central axis of the muffler. Inlet tube 3 is axially aligned with and faces the open end of that tubular member. The inlet end of resonator tube 19 is longitudinally spaced a short distance along the central axis from the outlet end of tube 3. Tubular member 19 extends deep into chamber 15 and terminates short of contact with the opposite wall 17 of that chamber. Tubes 3, 19 and 5 are centrally located relative to the side walls 7 of the muffler case and are coaxial with the central axis of the muffler.

Chamber 15 constitutes a Helmholz resonator, while tubular member 19 constitutes a tuned port for that resonator. Hence, the length of that tube (along with the volume of chamber 15) is important to the function of the muffler, namely, the suppression of sound. Due to the complexity of sound, the length of the tube and the volume of the chamber is determined principally through trial and error consistent with available space in a standard size muffler casing.

A fourth tube 21 is located inside the muffler case to one side of tube 19. Tube 21 extends through chamber 15 and both walls 13 and 17, with the remote edge extending a short distance beyond wall 17. The tube, referred to as a feed-through tube, is open at both ends and forms a direct open passage from chamber 9 into still another chamber 23, located to the right, referred to as the baffle chamber. Exhaust gas that is forced into feed-through tube 21 empties into the baffle chamber.

Baffle chamber 23 is defined between internal divider wall 17, end wall 25 and casing wall 7. A series of baffles 2, 4, 10, 12, 6, 8, and 14, formed of curved surfaces, is located inside chamber 23, between wall 17, shown to the left in the figure, and the inlet end of the outlet tube 5 in end cap wall 25, shown to the right in the figure. Baffles 2, 4, 6 and 8 in geometry form segments of the wall of a right cylinder. Those baffles appear in section in FIG. 1 as a circular arc, a segment of a circle of less than one-hundred and eighty degrees in arcuate extent. In the illustrated embodiment, the arc is one-hundred and twenty degrees. Baffles 10 and 12 in geometry form a half-cylindrical wall of a right cylinder and appear in section as semi-circles. Baffle 14, which, like baffle 2, in geometry constitutes a segment of the wall of a right cylinder, e.g. one-hundred and eighty degrees, and appears in the top view as a circular arc or segment of a circle of less than one-hundred and eighty degrees in arcuate extent.

Baffles 2 and 4 are essentially identical in structure. The two baffles are positioned in symmetric relationship with the central axis of the muffler with the respective convex surfaces of those components facing wall 17 and the adjacent edges of the two baffle walls are in spaced relationship, evenly spaced from the central axis. Baffles 10 and 12 are positioned on the central axis of the muffler with the baffles surface being located symmetric relative to that axis and with the concave surfaces of those baffles facing in opposite directions. The concave wall surface of baffle 10 faces the end of tube 19, while the corresponding wall of baffle 12 faces in the opposite direction. Preferably, baffles 10 and 12 are identical in size and shape.

Baffles 6 and 8 are axially displaced to the right of baffles 10 and 12 in the figure. Those baffles are oriented with the concave surfaces thereof facing the direction of wall 17 and with the convex surfaces of each baffle facing in the direction of outer muffler wall 25 and exhaust gas outlet tube 5. Like baffles 2 and 4, baffles 6 and 8 are positioned in symmetric relationship to the central axis of the muffler and with the edges of the two baffle walls in spaced relationship, evenly spaced from the central axis. Preferably, baffles 6 and 8 are identical in size and shape and identical in size and shape with baffles 2 and 4.

Baffle 14 in geometry forms a segment of the wall of a right cylinder. The baffle appears in section in the figure as a circular arc, a segment of a circle of less than one-hundred and eighty degrees in arcuate extent. In the illustrated embodiment, the arc is one-hundred and twenty degrees. Baffle 14 is positioned on the central axis of the muffler symmetric with respect to the central axis and in front of the inlet of the tubular muffler outlet 5 with the concave surface facing the space between baffles 6 and 8 and the convex surface of the baffle facing the wall 25 and outlet 5.

In this embodiment, baffles 2, 4, 6, 8 and 14 are essentially identical in size, including height, and shape and are constructed of the same metal. For one, the foregoing identical construction minimizes the number of separate stock keeping units needed for the components that ideally reduces inventory and construction cost. Baffles 10 and 12 are also essentially identical in size and shape and are greater in angular length than any of baffles 2, 4, 6 or 8.

Figure 2:
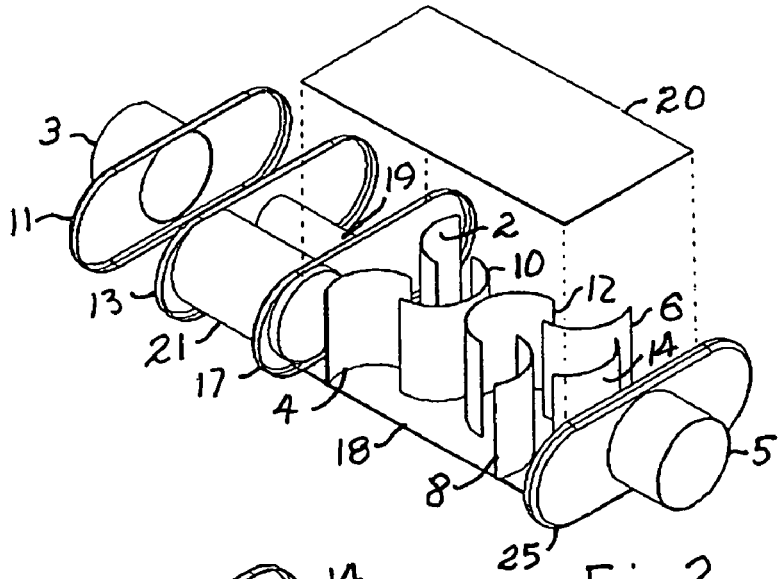
FIG. 2 is an exploded three dimensional view of the embodiment of FIG. 1 viewed from the outlet end and turned about the axis by 180 degrees with the casing removed.
Figure 3:
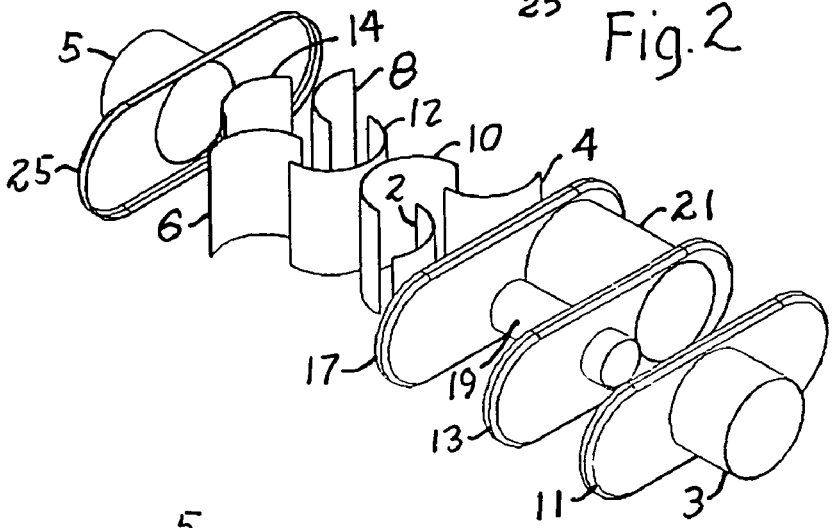
FIG. 3 is the exploded three-dimensional view of FIG. 2 with the embodiment viewed from the inlet end and the support plates for the baffle components omitted.

Reference is made to FIG. 2, showing the muffler of FIG. 1 in exploded three-dimensional view, drawn to a smaller scale and rotated 180 degrees about the central axis. The muffler is oriented with the outlet 5 end virtually positioned closest to the reader. FIG. 3 is the exploded view of FIG. 2 as viewed from the inlet end and with panels 18 and 20 omitted for clarity. Muffler casing 7 is also omitted from the two figures for clarity. In both views, the numbering of the component elements is the same number used for the elements that was used in FIG. 1. As better illustrated in FIGS. 2 and 3, the front wall 11, rear 25 wall and chamber walls 13 and 17 are oblong in geometry.

Figure 5A:
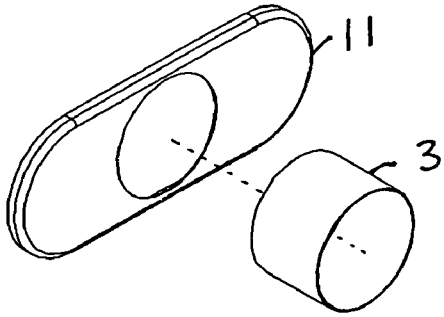
FIGS. 5A-5E illustrate stages in the assembly of the muffler.
Figure 5B:
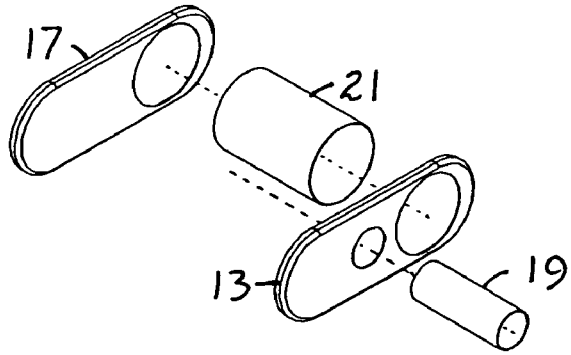
Figure 5C:
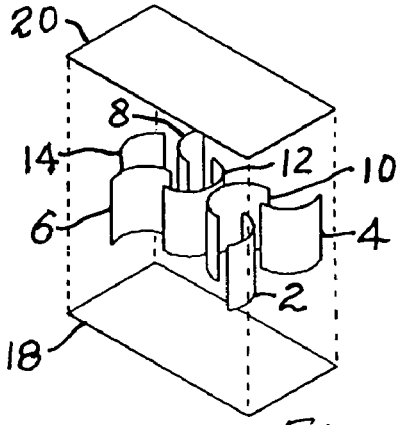
Figure 5D:
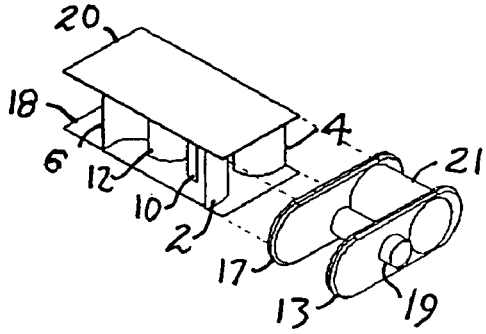
Figure 5E:
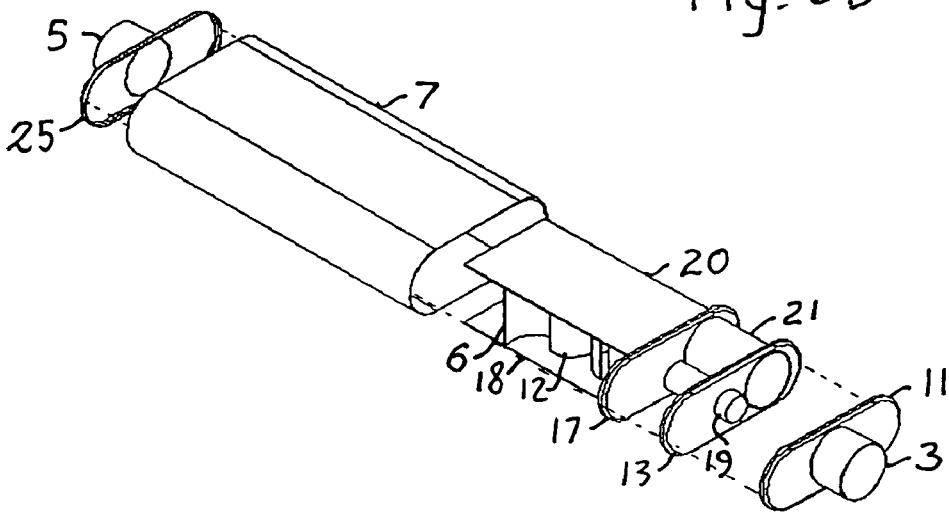

The foregoing components are formed of mild Aluminized steel, steel that is sprayed with hot aluminum to form a corrosion resistive coating on the steel, and are stamped and forged to shape. The components is assembled and welded together. Reference is made to FIGS. 5A through 5E. The inlet wall 11 is formed and the inlet tube 3 welded to a circular hole cut through that wall as represented in FIG. 5A. The outlet wall 25 is formed and the outlet tube 5 is welded to a circular hole cut there through that is essentially identical with that shown in FIG. 5A. The resonator assembly is formed as illustrated in FIG. 5B. Tubes 19 and 21 are welded to appropriately sized circular holes formed in chamber walls 13 and 17 and the tube and walls form a second subassembly. Referring next to FIG. 5C, the baffles 2, 4, 6, 8, 10, 12, and 14 are cylindrical sections of the same short height to fit within the short height of casing 7. Those baffles are positioned on a panel-like support member 18 and are spot welded in place. A second like-sized panel 20 is placed over the topside of those baffles and is spot welded to the opposite edge of the baffles to produce a sandwich-like assembly that forms a separate sub-assembly. The baffle subassembly and the resonator subassembly, referring to FIG. 5D, are welded together with the far edge of each of panels 18 and 20 being welded to chamber wall 17 of the last mentioned subassembly. That joint assembly is then inserted inside the oblong casing 7, as illustrated in FIG. 5E, and the inlet and outlet walls and tubes 5 & 25 and 3 & 11 are positioned in place and are ultimately welded to the case.

Figure 4:
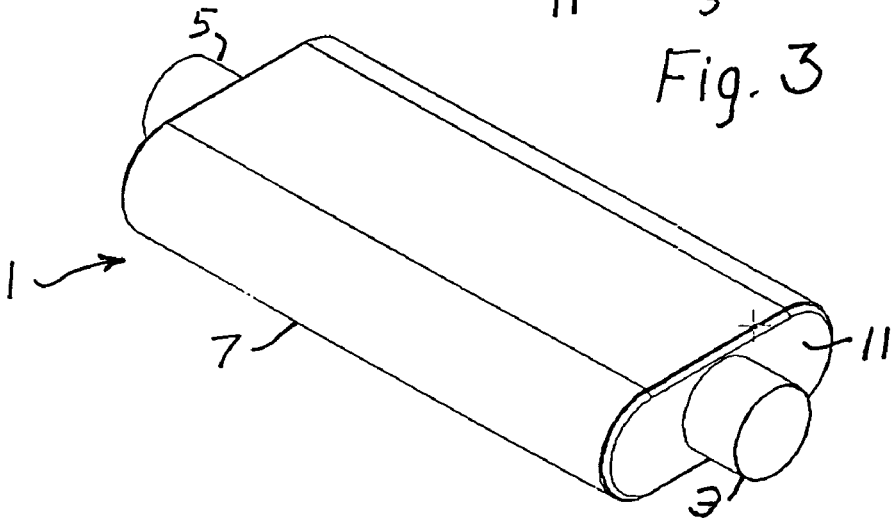
FIG. 4 is a isometric exterior view of a completed muffler embodiment.

Oblong casing 7, also illustrated in FIG. 4 to which brief reference is made, is partially formed into an oblong shape that is initially open at both ends and along a seam, represented by a dash line in the figure, that extends the length of the muffler. The joined subassemblies are placed inside the incompletely formed casing on one of the relatively flat sides. Then the casing is pressed into the oblong shape squeezing an end of the confined members to close the longitudinal seam. A weld is made along that seam to fully assemble the muffler. The outlet wall 25 is placed at one end of the casing and the edge of the panel 18 of the subassemblies is pushed into contact with that wall, and the two are welded together.

In a practical embodiment, tube 19 is 4.0 inches in length and projects into the entry chamber 9 by 0.75 inches, inlet tube 3 is greater than 1.5 inches in diameter (and is whatever size is dictated by the catalytic converter of the automobile in which the muffler is used), the entry chamber 9 is 3.5 inches in length, resonator chamber 15 is 4.0 inches long, and the baffle chamber 23 is 11.0 inches in length. The outlet tube 5 is approximately 1.5 to 2.0 inches in radius. Passage 21 is 3.0 inches in diameter and about 4.38 inches in length. That tube protrudes into the baffle chamber by about 0.38 inch. Each of baffles 2, 4, 6, 8 and 14 are of an arcuate length of 120 degrees, three inches in diameter and 3.375 inches in height. The right hand edge of baffles 2 and 4 in the figure is spaced 2.69 inches from resonator wall 17 and is longitudinally displaced along the central axis from the front edge of baffle 10 by 0.50 inches. The front edge of baffle 10 is longitudinally displaced from the front edges of baffle 12 by 3.25 inches. The adjacent edges of baffles 6 and 8 are longitudinally spaced from the back wall 25 of the muffler by 0.50 inches. The width of the casing at the maximum is about 9⅛$^{th}$ inches.

Cancellation of the harsh sound waves generated during engine operation is accomplished principally by the Helmholtz resonator 15 that is acoustically coupled to entry chamber 9. Acoustic energy is believed to be reflected back from the chamber to cancel out at least part of the harsh sound presented in the entry chamber. That doesn't cancel all the harsh sound. Suppression of the remnant high and midrange sound, including the repetitive sound that mimics the periodic firing of the multiple cylinders of the engine is accomplished by the arcuate shaped baffles. The baffles are arranged in a pattern so sound wave energy is focused and redirected back upon the incoming sound waves. Location, shape and width of the baffles will vary by specific engine application. It is found that using the combination of resonator chamber and multiple arcuate baffles suppresses exhaust sound with only a minimal amount of restriction of the flow of the exhaust gases.

As those skilled in the art appreciate, no two engines are perfectly identical with one another and the economic reality of production does not permit a manufacturer to optimize a muffler to individual engines to obtain optimal result for each individual. Instead, a muffler design is intended to be generally satisfactory in operation when used an engine that falls with a group of engines specified by the muffler manufacturer. In the present case the described practical embodiment of the muffler was designed for and used with the V8 gasoline engine of the General Motors company, and should obtain satisfactory result when used with other of those engines as well as any gasoline engine. In testing it was found that the noise levels generated by the engine equipped with a model 943051 muffler of a known third party performance muffler manufacturer was 116 db. When the muffler described in the present application was attached to the engine exhaust system for that engine, the resultant sound was reduced to 112 db. Further the frequency of the sound was a low melodious rumble. From continued operation over three to four months of a one-hundred and sixty mile round-trip commute no hot spots were developed in the muffler that were intense enough to warp or melt the casing wall.

In the foregoing embodiment, the inlet 3 is positioned along the central axis of the muffler. However, as should be realized that the positioning of the inlet is principally a function of the particular automobile engine. Due to space constraints in the undercarriage of the vehicle, the inlet in some automotive designs is necessarily offset from the central axis of the muffler. In such an alternative embodiment the inlet is offset and the tube 19 is positioned coaxial with the axis of inlet 3. The tubular passage 21 is then centrally positioned in walls 13 and 17 coaxial of the central axis of the muffler. The baffles 2, 4, 6, 8, 10, 12 and 14 remain positioned as shown in FIG. 1. Likewise the outlet 5 is subject to the same under carriage constraints as the inlet, and, in some instances, that may require the outlet to be offset from the central axis of the muffler. Whether outlet 5 is coaxial of the muffler central axis or is offset therefrom does not adversely affect the function of the resonator chamber or baffles or require a change of location of those components. To ensure understanding such an alternative embodiment is presented in the pictorial schematic of FIG. 4. Even though some of the components are relocated, the relative dimensions of those elements remains unchanged. The sound suppression is substantially the same.

In the foregoing embodiment, the curved baffles were sections of a cylinder in shape. However, the invention can also be accomplished with curves of near cylindrical shape, such as a parabolic shape. Thus the segments of a cylinder may be approximated by parabolas, if desired.

It is believed that the foregoing description of the preferred embodiments of the invention is sufficient in detail to enable one skilled in the art to make and use the invention without undue experimentation. However, it is expressly understood that the details of the elements for that embodiment presented for the foregoing purpose is not intended to limit the scope of the invention in any way, in as much as equivalents to those elements and other modifications thereof, all of which come within the scope of the invention, will become apparent to those skilled in the art upon reading this specification. Thus, the invention is to be broadly construed within the full scope of the appended claims.

What is claimed is:

1. An exhaust muffler for a land vehicle comprising:

a first entry chamber;

an exhaust gas inlet for providing a passage for exhaust gas from an internal combustion engine into said first entry chamber;

a resonator chamber;

a resonator inlet tube for said resonator chamber, said resonator inlet tube for providing a passage from said entry chamber into said resonator chamber;

a baffle chamber, said baffle chamber including a front wall and a rear wall;

an exhaust gas outlet located in said rear wall of said baffle chamber for providing an exhaust gas passage from said baffle chamber to the exterior environment;

a pass-through tube, said pass-through tube for providing an exhaust gas passage from said first entry chamber, through said resonator chamber and into said baffle chamber;

a baffle system, said baffle system comprising:

a plurality of curved sound reflective baffles positioned in said baffle chamber spaced from said front and rear walls of said baffle chamber for obstructing a direct path for sound to said exhaust gas outlet and scattering sound admitted into said baffle chamber via said pass-through tube about said baffle chamber, whereby interference patterns of reflected sound are produced that lessen the intensity of the sound that exits from said outlet tube along with exhaust gas;

said sound reflective baffles comprising a thin non-reentrant curved surface, said thin non-reentrant curved surface defining a concave shape on a first side and a convex shape on a second side, opposite to said first side; some of said thin non-reentrant curved surfaces having said first side facing said rear wall of said baffle chamber and a first side of at least a first adjacent thin non-reentrant curved surface and others of said thin non-reentrant curved surfaces having said second side facing said rear wall of said baffle chamber and a first side facing a first side of at least a second adjacent thin non-reentrant curved surface; and said second sides of said first and second adjacent thin non-reentrant curved surfaces being oriented immediately adjacent to and facing one another.

2. The exhaust muffler for a land vehicle as defined in claim 1, wherein said thin non-reentrant curved surface comprises a cylindrical curved surface.

3. The exhaust muffler for a land vehicle as defined in claim 1, wherein said thin non-reentrant curved surface comprises a parabolic surface.

4. The exhaust muffler for a land vehicle as defined in claim 1, wherein said plurality of sound reflective baffles comprise seven in number; and wherein at least two of said thin non-reentrant curved surfaces comprise a half-cylindrical surface and wherein at least five of said thin non-reentrant curved surfaces comprise a segment of a cylindrical surface that is significantly smaller than a half-cylinder.

5. An exhaust muffler for a land vehicle comprising:

a first entry chamber;

an exhaust gas inlet for providing a passage for exhaust gas into said first entry chamber;

a resonator chamber;

a resonator inlet tube for said resonator chamber, said resonator inlet tube for providing a passage from said entry chamber into said resonator chamber;

a baffle chamber;

an exhaust gas outlet for providing a passage from said baffle chamber to the exterior environment;

a pass-through tube, said pass-through tube for providing an exhaust gas passage from said first entry chamber, through said resonator chamber and into said baffle chamber;

a baffle system, said baffle system comprising:

a plurality of sound reflective baffles positioned in said baffle chamber for obstructing a direct path for sound to said exhaust gas outlet and scattering sound admitted into said baffle chamber via said pass-through tube about said baffle chamber, whereby interference patterns of reflected sound are produced that lessen the intensity of the sound that exits from said outlet tube along with exhaust gas;

said plurality of sound reflective baffles including:

first and second arcuate baffles;

said first and second arcuate baffles each including convex and concave shaped sides; said first and second arcuate baffles being mounted in laterally spaced relationship with one another with said convex shaped sides thereof facing in the direction of a rear end wall of said resonator chamber, leaving said concave shape sides facing away from said rear end wall of said resonator chamber;

third and fourth arcuate baffles;

said third and fourth arcuate baffles each including convex and concave shaped sides;

said third and fourth arcuate baffles being mounted in laterally spaced relationship with one another with said convex shaped sides thereof facing away from said rear wall of said resonator chamber, leaving said concave shape sides facing in the direction of said rear end wall of said resonator chamber;

said third and fourth arcuate baffles further being mounted in longitudinally spaced relationship to said first and second arcuate baffles;

fifth and sixth arcuate baffles;

said fifth and sixth arcuate baffles each including convex and concave shaped sides;

said fifth and sixth arcuate baffles being mounted in longitudinally spaced relationship in between said first and second arcuate baffles and said third and fourth arcuate baffles;

said fifth arcuate baffle mounted with said concave surface thereof facing in the direction of said rear wall of said resonator chamber and said sixth arcuate baffle mounted with said concave surface thereof facing away from said rear wall of said resonator chamber.

6. The exhaust muffler for a land vehicle as defined in claim 5, wherein each of said first, second, third and fourth arcuate baffles comprises a segment of a cylinder.

7. The exhaust muffler for a land vehicle as defined in claim 6, wherein each of said segments comprises an arc of one-hundred and twenty degrees.

8. The exhaust muffler for a land vehicle as defined in claim 5, wherein each of said fifth and sixth arcuate baffles comprises a half-cylinder.

9. The exhaust muffler for a land vehicle as defined in claim 7, wherein each of said fifth and sixth arcuate baffles comprises a semi-cylinder.

10. The exhaust muffler for a land vehicle as defined in claim 5, wherein said muffler includes a central axis; wherein said first and second arcuate baffles are further positioned symmetrically about said central axis, wherein said third and fourth arcuate baffles are further positioned symmetrically about said central axis, and wherein both said fifth and sixth arcuate baffles are positioned coaxial with said central axis.

11. The exhaust muffler for a land vehicle as defined in claim 10, wherein said seventh arcuate baffles is positioned coaxial with said central axis.

12. The exhaust muffler for a land vehicle as defined in claim 10, wherein said feed through tube is positioned coaxial with said central axis.

13. The exhaust muffler for a land vehicle as defined in claim 10, wherein said exhaust gas inlet, said exhaust gas outlet and said resonator tube are positioned coaxial with said central axis.

14. An exhaust muffler for a land vehicle comprising:

a first entry chamber;

an exhaust gas inlet for providing a passage for exhaust gas into said first entry chamber;

a resonator chamber;

a resonator inlet tube for said resonator chamber, said resonator inlet tube for providing a passage from said entry chamber into said resonator chamber;

a baffle chamber;

a rear muffler wall;

an exhaust gas outlet mounted in said rear wall for providing a passage from said baffle chamber through said rear wall to the exterior environment;

a pass-through tube, said pass-through tube for providing an exhaust gas passage from said first entry chamber, through said resonator chamber and into said baffle chamber;

a baffle system, said baffle system comprising:

a plurality of sound reflective baffles positioned in said baffle chamber symmetrically positioned about a central axis for obstructing a direct path for sound to said exhaust gas outlet and scattering sound admitted into said baffle chamber via said pass-through tube about said baffle chamber, whereby interference patterns of reflected sound are produced that lessen the intensity of the sound that exits from said outlet tube along with exhaust gas; wherein said plurality of baffles including:

first and second baffles each having the shape of a circular arc of about one-hundred and twenty degrees;

said first and second baffles each including convex and concave shaped sides;

said first and second baffles being mounted at a second longitudinal position along said central axis and laterally spaced symmetrically to said central axis and with said convex shaped sides thereof facing in the direction of a rear end wall of said resonator chamber, leaving said concave shape sides facing away from said rear end wall of said resonator chamber;

third and fourth baffles each having the shape of a circular arc of about one-hundred and twenty degrees;

said third and fourth baffles each including convex and concave shaped sides;

said third and fourth arcuate baffles being mounted in spaced relationship at a second longitudinal position along said central axis and laterally spaced symmetrically to said central axis with said convex shaped sides thereof facing away from said rear wall of said resonator chamber, leaving said concave shape sides facing in the direction of said rear end wail of said resonator chamber;

said third and fourth baffles further being mounted in longitudinally spaced relationship to said first and second arcuate baffles;

fifth and sixth baffles each having the shape of a circular arc of about one-hundred and eighty degrees;

said fifth and sixth baffles each including convex and concave shaped sides;

said fifth and sixth baffles being mounted coaxial of said central axis and at third and fourth longitudinal positions along said central axis, respectively, in between said first and second longitudinal positions along said axis and spaced from said first, second, third and fourth baffles;

said fifth baffle mounted with said concave surface thereof facing in the direction of said rear wall of said resonator chamber and said sixth baffle mounted with said concave surface thereof facing away from said rear wall of said resonator chamber;

a seventh baffle having the shape of a circular arc of about one-hundred and twenty degrees;

said seventh baffle having a convex shaped side and a concave shaped side;

said seventh baffle being mounted symmetrically coaxial with said central axis at a fifth longitudinal position located in front of said rear muffler wall and longitudinally spaced from said third and fourth arcuate baffles with said convex shaped side thereof facing said rear muffler wall and said concave shaped side thereof facing in the direction of said rear wall of said resonator chamber.

* * * * *